United States Patent [19]

Watanabe et al.

[11] 4,117,778

[45] Oct. 3, 1978

[54] HIGH SPEED PRINTER WITH ARC PREVENTING FLUOROCARBON GAS

[75] Inventors: Akinori Watanabe; Katsuhide Tanoshima; Matsusaburo Noguchi; Kinya Hattori, all of Tokyo, Japan

[73] Assignee: Oki Electric Industry Co., Ltd., Tokyo, Japan

[21] Appl. No.: 801,206

[22] Filed: May 27, 1977

Related U.S. Application Data

[63] Continuation of Ser. No. 618,809, Oct. 2, 1975, abandoned.

[30] Foreign Application Priority Data

Oct. 30, 1974 [JP] Japan ..... 49/124270

[51] Int. Cl.[2] ..... H01T 19/04; B03C 3/40

[52] U.S. Cl. ..... 101/1; 101/DIG. 13; 101/114; 427/21; 427/39; 55/150; 346/153; 250/324

[58] Field of Search ..... 101/1, DIG. 13, 114, 101/426; 250/324–326, 423; 96/1 PE; 355/3; 427/21, 39; 346/75, 153; 55/107, 150

[56] References Cited

U.S. PATENT DOCUMENTS

| | | | |
|---|---|---|---|
| 3,108,900 | 10/1963 | Papp | 427/39 |
| 3,273,496 | 9/1966 | Melmon | 101/DIG. 13 |
| 3,373,019 | 3/1968 | Bixby | 355/3 R X |
| 3,483,374 | 12/1969 | Erben | 250/326 X |
| 3,592,541 | 7/1971 | Gourdine | 101/DIG. 13 |
| 3,625,604 | 12/1971 | Pressman | 101/DIG. 13 |
| 3,646,910 | 3/1972 | Cade et al. | 250/326 X |
| 3,673,463 | 6/1972 | Gourdine | 55/107 X |
| 3,779,166 | 12/1973 | Pressman et al. | 101/DIG. 13 |
| 3,794,839 | 2/1974 | Hayne | 250/324 |
| 3,862,420 | 1/1975 | Banks et al. | 250/324 |

*Primary Examiner*—E. H. Eickholt
*Attorney, Agent, or Firm*—Peter L. Berger

[57] ABSTRACT

A high speed printer in which ions produced between the high voltage impressed electrodes are modulated and then passed through an ink mist to electrically charge the ink particles to thereby print desired letters, figures, signs, etc., on a printing paper, characterized in that an electronegative gas containing a fluorine component and not containing any chlorine component is flown into the aperture board to prevent are discharge that would otherwise take place between the anode and aperture board.

3 Claims, 3 Drawing Figures

HIGH SPEED PRINTER WITH ARC PREVENTING FLUOROCARBON GAS

This is a continuation of patent application Ser. No. 618,809, filed Oct. 2, 1975, which is now abandoned.

BACKGROUND OF THE INVENTION

Elevated operating speed of central processor units of electronic computers has demanded corresponding speed-up of high speed printing machine which are an output unit, and various improvements have been made to meet such demand.

A typical example of such improvements is a system in which ink is supplied to the nuzzle under a very low pressure so that ink swells out half-spherically from the nozzle end, then ink is drown out in the form of droplets by giving an electric field between said nozzle and an accelerating electrode placed several millimeters ahead of the nozzle, and then the ink droplets are directed toward the surface of the printing paper by giving a strong electric field between the nozzle and a back bar and further electrostatically deflected in both primary and secondary directions (right and left directions) to thereby print letters, signs, etc., on the surface of the printing paper.

There is also known a system in which ions produced between the high voltage impressed electrodes are passed through an ink mist so that they carry therewith the ink particles, and then these ink particle carrying ions are selectively adsorbed on the surface of the printing paper to thereby effect printing.

The present invention pertains to the last-mentioned system, and so this system is first described for facilitating understanding of the present invention.

Referring to FIG. 1 which diagrammatically depicts the said system, a high voltage is applied between an anode 101 and a cathode 102 to yield cations from the anode 101. These cations are attracted toward the cathode 102 and attempt to advance through an aperture board 103. This aperture board 103, as shown in FIG. 2, consists of controlling conductive layers 105, a common conductive layer 106 and an insulating layer 107 interposed therebetween, said layers being formed surrounding each of the openings 104 in the board, and the cations pass the openings 104. Voltage of a predetermined value is applied to said both controlling conductive layers 105 and common conductive layer 106 to form an electric field in each of said openings 104, so that said cations are controlled so as to pass or so as not to pass the openings by changing the direction of said electric field by properly selecting the potential of the controlling conductive layers 105 with relation to the common conductive layer 106. Said openings 104 are provided in plurality in lines, and the cations which have passed these openings impinge against the ink particles while passing the ink mist to electrically charge said ink particles. The ink mist is produced by vibrating the ink solution 109 in an ink mist generator 108 by supersonic vibrators 110 and discharged out from an outlet 111. The electrically charged ink particles are attracted to the cathode 102 of a back bar 112 and deposited on a printing paper 113 to print dots. In this way, letters, etc., in the form of a dot matrix are printed by programming selection of voltage of the controlling conductive layers 105 as main scanning and feed of the printing papers 113 as auxiliary scanning.

In such electrostatic high speed printers, maintenance of stable corona discharge is an essential requirement, but undesirable are discharge may occur to adversely affect the printing condition.

This inventor has found out a solution to this problem by feeding air containing a negative gas such as chlorothen into the aperture board. This method has excellent effect in preventing are discharge from occuring between the anode 101 and aperture board 103, but it still has a problem that the respective conductive layers of the aperture board 103 could be corroded by the gas fed in.

SUMMARY OF THE INVENTION

In order to overcome the above-said problem, the present invention features feeding of an electro-negative gas containing a fluorine component and not containing any chloride component into the aperture board to thereby prevent are discharge that could otherwise take place between the anode and aperture board.

OBJECTS

The first object of the present invention is to maintain stable corona discharge to prevent deterioration of the printing condition.

The second object of the present invention is to prevent are discharge that might occur between the anode and aperture board.

The third object of the present invention is to prevent are discharge while keeping the respective conductive layers of the aperture board safe from corrosion.

DETAILED DESCRIPTION OF THE INVENTION

Figure 1:
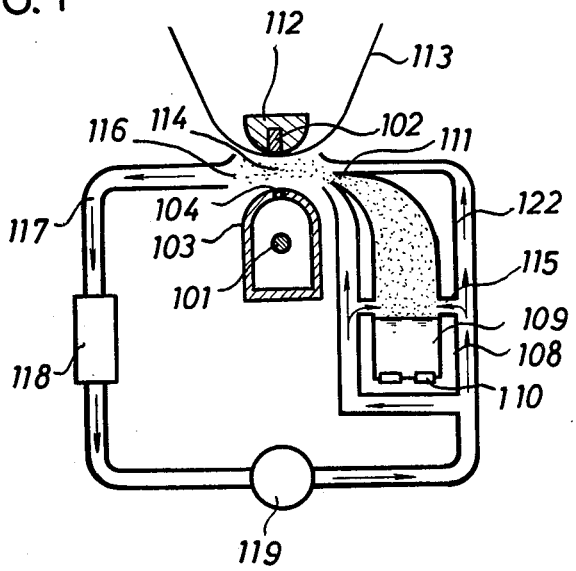
FIG. 1 is an illustrative system diagram of a high speed printer according to the present invention.
Figure 2:
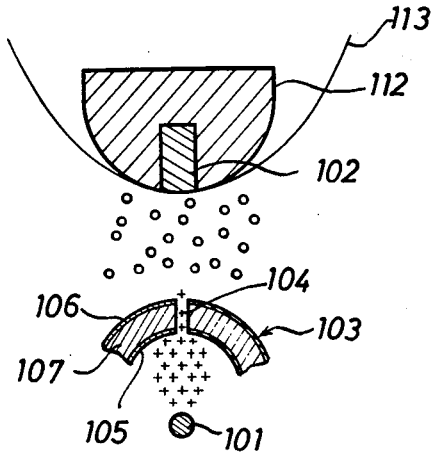
FIG. 2 is an illustrative sectional view showing the relationship among the anode, aperture board and cathode.
Figure 3:
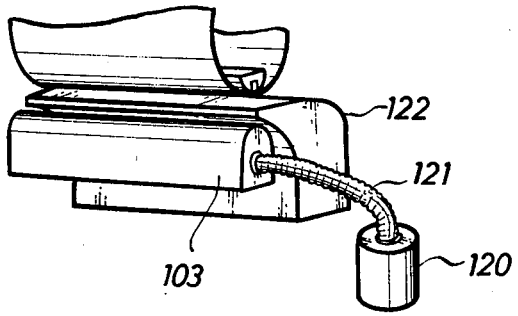
FIG. 3 is an illustrative diagrammatic perspective view showing the essential parts of the high speed printer according to the present invention.

An aperture board 103 is provided between an anode 101 formed from a wire-like electrode or such and a cathode 102 embedded in a back bar 112. This aperture board 103 has controlling conductive layers 105 on the anode side and a common conductive layer 106 on the cathode side, with an insulating layer 107 being interposed therebetween, and a plurality of openings 104 are formed longitudinally of the board in a staggered relation to each other, with an ion controlling electrode being formed for each of these openings. The selective conductive layers 105 are connected to a driving circuit, not shown, and selectively driven to a positive or negative potential with relation to the potential of the common conductive layer 106 which is maintained at a constant potential.

A means is provided for supplying ink mist to the printing section 114 between said aperture board 103 and back bar 112. According to this means, ink mist is formed by supersonic vibrators 110 provided at the bottom of a mist generator 108 which contains ink solution 109, and the thus formed ink mist is carried to the printing section 114 from a discharge port 111 by the air which was introduced into the system from air inlets 115 provided at the upper side face of said mist generator 108. Provided in opposition to said discharge port 111 is an ink mist and air collecting port 116 which is connected to a separator 118 through a conduit 117 and further to a main pump 119 via a cooler or like means.

A tank 120 containing a carbon fluoride gas ("Florinate" (tradename) was used for test) is provided alongside the aperture board 103 and connected thereto by a pipe 121 for feeding said gas into the aperture board 103. This carbon fluoride gas is an electronegative gas and does not contain any chloride component unlike the chlorothen-containing gas, so that it won't produce hydrochloric acid or such by reacting with moisture in the aperture board during discharge, and hence it has no possibility of corroding the conductive layers of the aperture board. It may of course be fed in admixture with air to provide dilute gas.

Now the operation of the system having the just described arrangements is described. In order to obtain a desired printing pattern, each of the selective conductive layers 105 is driven to control migration of the cations for all of the openings 104, and the cations which have passed the openings 104 enter the ink mist to carry therewith the fine ink particles. They continue their migration toward the cathode 102 until they are finally adsorbed on the printing paper 113 to effect printing by dots. This printing operation is carried out all together along the width of the printing paper 113, and letters composed of dot patterns are printed all together in lines with the above-said operation being programmed as main scanning and feed of printing paper 113 as auxiliary scanning.

The ink mist which is to be supplied to the space between the printing paper 113 and aperture board 103 is produced by vibrators 110 provided in the mist generator 108. This ink mist is first guided into a reservoir tank 122 along with air and discharged out from the discharge port 111 with a uniform density. A part of the ink mist thus discharged out is put to use for printing in dots as said above while the remainder is collected at the collecting port 116 together with air stream, and the mixture is led into a separator 118 where the ink particles are separated from air, with the latter being further guided into a cooler for cooling and thence led into the main pump 119 whereby air is partly supplied into the reservoir tank 122 and partly used as fresh air stream for printing operation.

Throughout the above-said operation, said carbon fluoride gas is supplied into the aperture board 103 from the tank 120 to prevent occurence of arc discharge between the anode 101 and aperture board 103.

As described above, according to the high speed printer of the present invention, it is possible to prevent undesirable are discharge from occuring between the anode and aperture board, allowing maintenance of stable corona discharge to ensure uniform printing operation. Also, as the carbon fluoride gas used for preventing are discharge is an electronegative gas and does not contain any chlorine component, it never produces hydrochloric acid or such by reacting with moisture in the aperture board during discharge, and hence it has no possibility of corroding the conductive layers of the aperture board, so that the conductive layers are greatly enhanced in durability.

What is claimed is:

1. A high speed printer comprising an anode and a cathode respectively charged to cause ions to move from said anode to said cathode, an aperture board for modulating said ions, said aperture board enclosing said anode and having an aperture through which said ions may pass to be modulated, an ink mist located between said aperture board and said cathode such that said modulated ions combine therewith to electrically charge the ink particles of the ink mist to perform printing, and gas supply means connected to said aperture board to supply an electronegative gas consisting essentially of a fluoride compound to the region within said aperture board between said anode and said aperture board to prevent corona arc discharge and to prevent corrosion of said aperture board.

2. A high speed printer as set forth in claim 1 wherein said electronegative gas comprises a fluorocarbon gas.

3. A high speed printer as set forth in claim 1 wherein said gas supply means comprises a tank containing said electronegative gas and a pipe connecting said tank to said aperture board.

* * * * *

UNITED STATES PATENT AND TRADEMARK OFFICE

CERTIFICATE OF CORRECTION

PATENT NO. : 4,117,778

DATED : October 3, 1978

INVENTOR(S) : Akinori Watanabe et al.

It is certified that error appears in the above-identified patent and that said Letters Patent are hereby corrected as shown below:

In the Abstract, line 8, delete "are" and substitute therefor --arc--.

Column 2, line 1, delete "are" and substitute therefor --arc--.

Column 2, line 6, delete "are" and substitute therefor --arc--.

Column 2, line 17, delete "are" and substitute therefor --arc--.

Column 2, line 25, delete "are" and substitute therefor --arc--.

Column 2, line 28, delete "are" and substitute therefor --arc--.

Column 4, line 9, delete "are" and substitute therefor --arc--.

Column 4, line 13, delete "are" and substitute therefor --arc--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*